US006679335B2

(12) United States Patent
Slack et al.

(10) Patent No.: US 6,679,335 B2
(45) Date of Patent: Jan. 20, 2004

(54) METHOD FOR PREPARING CASING FOR USE IN A WELLBORE

(75) Inventors: Maurice William Slack, Edmonton (CA); Trent Michael Victor Kaiser, Edmonton (CA)

(73) Assignee: Tesco Corporation, Calgary (CA)

( * ) Notice: Subject to any disclaimer, the term of this patent is extended or adjusted under 35 U.S.C. 154(b) by 0 days.

(21) Appl. No.: 10/170,414

(22) Filed: Jun. 14, 2002

(65) Prior Publication Data

US 2003/0019637 A1 Jan. 30, 2003

(51) Int. Cl.[7] ..... E21B 17/08; E21B 17/22

(52) U.S. Cl. ..... 166/380; 166/242.1; 277/314; 277/559; 29/520

(58) Field of Search ..... 166/242.1, 380; 29/508, 515, 520; 277/314, 530, 559, 562, 603

(56) References Cited

U.S. PATENT DOCUMENTS 1,959,367 A 5/1934 Kennedye
3,360,846 A 1/1968 Schellstede et al.
2001/0006109 A1 7/2001 Kaiser et al.

FOREIGN PATENT DOCUMENTS

EP 0 783 074 A2 7/1997
WO WO 02/04783 1/2002

*Primary Examiner*—Roger Schoeppel
(74) *Attorney, Agent, or Firm*—Bennett Jones LLP

(57) ABSTRACT

A method for preparing casing for use in a wellbore such as for example, in preparation, for use to line a borehole through a formation or to act as a drill string and thereafter to remain in hole. In the method, a device supporting the use of the wellbore casing is crimped onto the outer surface of the casing. The device supporting casing use can be to facilitate run in through the borehole, to maintain positioning relative to the borehole, to accommodate wear against the wall of the borehole into which the casing is run or to enhance the results of cementing. The devices supporting the use of the casing are attached by crimping to the casing to create a connection having structurally significant axial and torque load transfer capacity.

25 Claims, 5 Drawing Sheets

METHOD FOR PREPARING CASING FOR USE IN A WELLBORE

CROSS REFERENCE TO RELATED APPLICATIONS

This application is a continuation-in-part of U.S. patent application Ser. No. 09/736,977 filed Dec. 14, 2000, by Maurice Slack, the specification of which is incorporated herein by reference.

FIELD OF THE INVENTION

The present invention relates to method for preparing casing for use in a wellbore.

BACKGROUND OF THE INVENTION

Within the context of petroleum drilling and well completions, wells are typically constructed by drilling the well bore using one tubular string, largely comprised of drill pipe, then removing the drill pipe string and completing by installing a second tubular string, referred to as casing, which is subsequently permanently cemented in place. The installation of casing, in this typical construction requires that the casing be run into long boreholes, some having horizontal stretches. In these horizontal stretches, the casing must be installed by pushing it along the borehole. In so doing the casing is pushed in engagement with the borehole wall.

Recent advances in drilling technology have enabled wells to be drilled and completed with a single casing string, eliminating the need to 'trip' the drill pipe in and out of the hole to service the bit and make room for the casing upon completion of drilling. This change is motivated by potential cost savings arising from reduced drilling time and the expense of providing and maintaining the drill string, plus various technical advantages, such as reduced risk of well caving before installation of the casing.

Once installed either in a standard way, by running in after a wellbore is drilled or by use as the drill string and the wellbore liner, casing is often cemented in place. Cementing is often adversely affected by movement of the casing once the cement has hardened.

The use of wellbore casing, including during installation through deviated wellbores or by drilling with casing and as a wellbore liner, challenges the performance requirements of the casing.

Any advancements in the wellbore casing wherein devices are attached to the outer surface of the casing, requires the devices be attached in a rugged way to the casing, since the devices must be installed at surface and conveyed downhole with the casing. In addition, any method for attaching the devices must not compromise the integrity of the casing and the devices themselves must be inexpensive since, even if used only to facilitate installation, they must be left downhole with the casing.

SUMMARY OF THE INVENTION

A method has been invented for preparing casing for use in a wellbore. The casing produced by the method is particularly suited to overcome one or more problems encountered in running casing into a borehole, using the casing as a drill string and cementing the casing in place in the borehole. In the method, a device supporting use of the casing in a wellbore is crimped onto the outer surface of the casing. The device supporting use of the casing in a wellbore can be a device for supporting installation of the casing, either by standard run in operations or by use as a drill string, or can be a device for supporting the cementing of casing into the borehole.

The device supporting casing installation can be to facilitate run in through the borehole, to maintain casing positioning relative to the borehole and/or to accommodate wear against the wall of the borehole into which the casing is run.

The device supporting casing cementing, can be to enhance engagement between the casing and the annular cement between the casing and the borehole wall.

The devices supporting the use of casing in a wellbore are attached to the casing to create a connection having structurally significant axial and torque load transfer capacity. When using methods according to the present invention, the load transfer capacity of the connection between the device and the casing can be arranged to substantially prevent significant relative movement of the device on the casing under loads that may be encountered when installing one or more of the casing joints as a liner into a wellbore which has been drilled using a conventional drilling operation or when using one or more of the casing joints as components of a tubular string used for drilling and lining a well bore.

Thus, in accordance with one aspect of the present invention, there is provided a method for preparing a casing joint for use in a wellbore, selecting a joint of casing having an outer diameter and an outer surface and capable of receiving a device thereon by crimping and selecting a device supporting the use of the casing in a wellbore, the device having an outer facing surface, an inner bore sufficiently large to allow insertion therethrough of the joint of casing, and at least one tubular section on the body, the portion of the inner bore extending through the tubular section having an internal diameter capable of loosely fitting about the outer diameter of the joint of casing; positioning the device on the joint of casing such that the joint of casing extends through the inner bore; and crimping the device onto the joint of casing by applying an inward, substantially radially-directed force to a plurality of points about an outer circumference of the tubular section causing it to plastically deform inwardly and come into contact with the outer surface of the joint of casing, applying such additional inward, substantially radially directed force as required to force both the tubular section of the device and the outer surface of the casing to displace inwardly an amount at least great enough so that when the force is released, an interference fit is created between the device and the casing.

The step of applying substantially radially-directed force to a plurality of points about an outer circumference of the tubular section is termed herein as "crimping".

Preferably, by selection of casing, device supporting use of the casing in a wellbore and/or force applied, the inward displacement of the casing outer surface is not so great that the drift diameter of the casing is excessively reduced. In one embodiment, the casing is not displaced inwardly beyond the drift diameter. However, in another embodiment, the inward displacement of the casing outer surface causes the inner diameter of the casing to be reduced beyond the drift diameter of the casing.

In one embodiment the method can be used to produce casing for wellbore completion, in another embodiment the method can be used to produce casing for use in a drill string and in another embodiment the method can be used to produce a casing joint particularly suited for cementing into a wellbore. The device supporting use of the casing can be selected from those useful for facilitating run in of the casing, those for controlling the positioning of the casing within the borehole, those for accommodating wear against the wall of the borehole into which the casing is run, those for use in anchoring the casing in the wellbore to inhibit relative movement between the casing string and the wellbore wall or those providing combinations of the foregoing.

Frictional forces enabled by the interference fit at the inwardly displaced section provide the mechanism by which structurally significant axial and torsional load may be transferred between the device and the casing substantially without slippage therebetween.

The casing on for use in the present invention must be capable of accepting the hoop stresses of crimping without becoming unstable, for example, without buckling or crumpling. This generally requires that the casing be thick-walled, for example, having an external diameter to thickness ratio ("D/t") less than 100 and preferably less than 50.

To be most generally useful for this method, the devices useful in the present invention should be amenable to rapid field installation on joints of casing having at least one non-upset end.

The tubular section of the device under application of load at a plurality of points about its circumference has an elastic resiliency less than the elastic resiliency of the casing onto which it is crimped. The tubular section can be cylindrical or largely cylindrical with some radial or axial variations to the internal diameter or outer surface. The tubular section should be substantially circumferentially continuous such that a hoop stress can be set up during the radially inward displacement at a plurality of points about the circumference of the outer surface of the section. The tubular section should be capable of accepting the hoop stresses of crimping without becoming unstable, for example, without buckling or crumpling. This generally requires that the section be thick-walled, for example, having an external diameter to thickness ratio ("D/t") less than 100 and preferably less than 50.

The loose fit of the section about the casing must be sufficient to accommodate the variations of the outer diameter of the casing intended to be used.

A device selected to facilitating run in of the casing can include a ramped leading edge to facilitate riding over surface contours on the borehole wall or to facilitate raising the casing such that protrusions, such as casing connections, on the casing outer surface can pass along the borehole without digging into the formation or getting hung up on shoulders in the borehole wall.

A device selected to accommodate wear against the wall of the borehole into which the casing is run can include bearing surfaces capable of withstanding extended abrasion against borehole surfaces and sufficient to withstand the rigors encountered during installation into or the drilling of at least one well. The bearing surfaces should withstand abrasion better than the material of the casing and can be, for example, hard facing, which is the treatment of steel to increase its hardness, ribs, lines of weldments, hardened inserts, etc.

A device selected from those useful for controlling the positioning of the casing within the borehole can provide for spacing the casing from the borehole wall in which it is to be used and, in particular, centralizing or stabilizing the casing within the hole. Thus, in one embodiment, the thickness of the device is selected such that once the bearing member is crimped onto the casing, the device extends radially out beyond the outer surface of the casing. In addition, the thickness of the bearing member at the bearing surfaces can be selected such that the bearing member acts as a centralizer or a stabilizer, with consideration as to the inner diameter of the borehole in which the casing is to be used.

A device selected to anchor the casing in the annular confining material, such as cement, has a plurality outwardly projecting abrupt diameter changes spaced along its length from end to end. By abrupt, is meant that the diameter changes create shoulder that preferably are substantially perpendicular to the axis of the casing or alternately may be sloped with an angle of at least 20°, and more preferably at least 45° relative to the axis of the casing. The ability to efficiently transfer axial load between the anchoring device and the wellbore wall through the confining material such as cement typically placed in the annulus between the casing and wellbore wall will depend on the tendency of the multiple abrupt diameter changes to displace the confining material as axial movement is attempted. To provide a significant improvement in the anchoring function of a threaded and coupled anchored casing joint, the total volume swept by the multiple abrupt diameter changes preferably should be of the same order as that already swept by the face of the casing joint coupling or collar for a given amount of axial movement. This collar face area is typically approximately equal to the joint body cross-sectional so that the swept volume is this area times the axial displacement. Therefore, it is preferred that the relevant upper or lower shoulder areas of the diameter changes of the anchoring device should in total create an area equal to the cross-sectional area of the anchored casing joint body. Otherwise stated, the total axial area presented by the diameter change or shoulder to the confining material in the direction of movement should preferably be at least equal to the cross-sectional area of the anchored casing joint tubular body.

In addition, the diameter changes preferably should be of sufficient magnitude to result in significant inter-penetration with the confining material. There may be gaps between the confining material and the anchor joint tubular outer surface, such as the micro-annulus reported to occur between cement and a tubular. In addition, the radial stiffness of the confining material may allow it to deflect away from surfaces where the diameter change tends to cause loading during axial displacement of the casing string. For these reasons, it is preferred that the diameter changes be greater than 0.5% of the tubular diameter, more preferably greater than 1% of the diameter.

In one embodiment, the method provides an a casing joint, termed herein an anchor joint, comprising a joint of steel well casing having external devices for anchoring, which are steel rings, affixed by crimping in locking engagement with the tubular wall. Preferably the rings are cylindrical, have a thickness about equal to the tube wall thickness and are spaced apart at least 10 ring thicknesses.

The number of rings and the length of the anchor joint should be selected with a view to providing adequate shoulder contact with the cement or other confining material to react the axial load tending to cause movement of the casing. Selecting the number of rings, the length of anchor joint and the frequency of anchor joints in a casing string will in part be determined by field experience.

In accordance with another aspect of the invention, there is provided a method for anchoring a casing string in a wellbore comprising: inserting a plurality of anchor joints at spaced intervals into a casing string as the string is being run into the wellbore; each anchor joint comprising a joint of casing having a plurality of external steel rings crimped in locking engagement with the joint at spaced positions along the joint; and cementing the anchor joints in the wellbore.

The external rings can be crimped onto the casing in any way such as by use of a clamp, split dies forced together by a press, collet jaws forced together by an axially loaded cone or compressor or by hydroforming. In one embodiment, a hydroforming process comprises; providing a thick-walled metal tubular compatible with a casing string; positioning a crimpable ring around the tubular, the ring being formed from a ductile material, such as steel, having a yield strength less than the tubular, the ring having an internal diameter slightly greater than the external diameter of the tubular and an external profile comprising end sections and a middle section of reduced outside diameter relative to the end sections; providing a pressure forming vessel around the ring, the vessel having an internal bore slightly larger than the outside diameter of the ring, the forming vessel having internal grooves, carrying seals, spaced to straddle the reduced diameter ring middle section and to seal against the end sections to define a pressure chamber between the seals; providing a stop tube, having a length at least equal to that of the ring, within the tubular in opposed relation to the ring, the stop tube preferably having an outside diameter less than the inside diameter of the tubular by an amount at least equal to twice the elastic limit displacement of the tubular; the vessel having a passage extending through its wall to communicate with the pressure chamber, introducing pressurized liquid into the pressure chamber through the passage and causing the ring and tubular side wall to deform inwardly until the side wall contacts the stop tube and the ring is affixed to the tubular; and repeating the foregoing steps to affix a plurality of rings to the tubular to produce an anchor joint.

As a further step, the anchor joint so produced is connected into a casing string and introduced into a wellbore.

In some aspects of the present invention, differential temperature may be used to control interference between the casing and the device supporting use of the casing according to the well known methods of shrink fitting, whereby the differential temperature is obtained by heating the device, cooling the casing, or both, prior to crimping.

However, it is preferable to avoid the requirement to either heat the device or cool the casing to obtain an interference fit. In particular, preferably sufficient interference in the crimped connection is obtained substantially only by mechanical means, without requiring a significant temperature differential between the device and the casing at the time of crimping. This purpose is realized by selecting the elastic limit of the device material, in the section to be crimped, to be less than that of the casing on which the centralizer is to be installed. In this context, the elastic limit generally refers to the strain at which the materials of the parts yield. Having the material properties thus selected, it will be apparent to one skilled in the art, that when the radial displacement applied during crimping is sufficient to force the hoop strain of the metal casing to be at least equal to its elastic limit, upon release of the load causing the radial displacement, the metal casing will tend to radially 'spring back' an amount greater than the centralizer, were both parts separated. Since the parts are not separated, the difference in this amount of spring back or resiliency is manifest as interference and fulfills the desired purpose of creating interference substantially only by mechanical means.

While a purely mechanical method of obtaining interference through crimping is desirable for most applications, the present invention can use both thermal and mechanical methods for attachment of the device to the casing.

To facilitate the frictional engagement of the crimped bearing member to the thickwall casing, the inside surface of the device, at least over the section to be crimped (i.e at least a portion of the inner surface defining the inner bore through the tubular section), can be provided with a roughened surface finish. In another embodiment, a friction enhancing material such as, for example, a grit-epoxy mixture is disposed in the interfacial region of the crimped section. Similarly, various bonding materials may be disposed in the interfacial region prior to crimping to act as glues augmenting the frictional aspects of the connection once their shear strength is developed after setting.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DESCRIPTION OF THE PREFERRED EMBODIMENT

Figure 1:
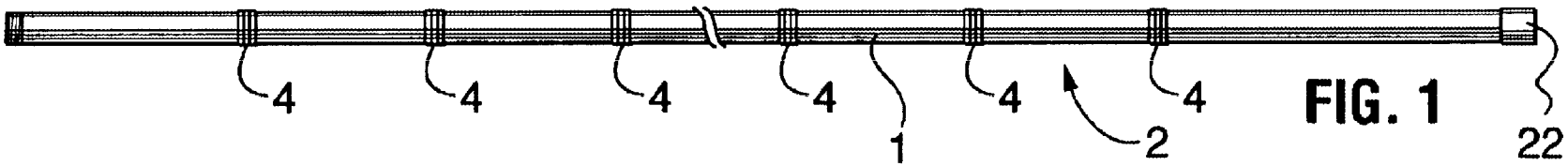
FIG. 1 is a side view of a casing anchor joint comprising a tubular having a plurality of crimped rings affixed thereto.

In accordance with one embodiment of the invention, a casing prepared for use in a wellbore is shown in FIG. 1, The casing is particularly adapted by connection of a device supporting cementing of the casing into the wellbore. The casing joint 1 of steel well casing is shown in FIG. 1 forming an anchor joint 2. The casing joint 1 met the following specification:

length—40 feet grade of steel—API L80 nominal inside diameter—6.366 inch nominal outside diameter—7 inch wall thickness—0.317 steel yield—80,000 psi

The casing joint 1 was threaded at each end to provide means for use in connecting it into a casing string 3. A coupling 22 was secured to one end of the joint 1.

A crimp ring 4 was positioned coaxially around the casing joint 1. The ring 4 met the following specification:

grade of steel—API K55 nominal inside diameter—7 inch length—4 inches steel yield—55,000 psi

The ring 4 had an indented outer surface 15 or profile, creating ring end sections 5, 6 and reduced diameter middle section 7, The wall thickness of each end section 5, 6 was 0.350 inches. The wall thickness of the middle section 7 was 0.245 inches.

A hydroforming assembly 8 was provided to simultaneously yield both the middle section 7 of the ring 4 and the casing joint side wall 9, to leave the ring locked or swaged in a detent 10 formed in the side wall. More particularly, the assembly 8 comprised a pressure forming vessel 11 having an internal bore 12 extending therethrough, for receiving the casing joint 1 and ring 4. The diameter of the bore 12 was 0.010 inches larger than the outside diameter of the ring 4. The interior surface 13 of the vessel 11 formed seal grooves 14 for receiving elastomeric cup seals 15, 16 which were positioned to seal against the end sections 5, 6, respectively. Suitable seals 15, 16 are available from Parker Seal Group within their POLYPAK® product category. To mitigate the tendency of even these high strength elastomeric seals to extrude, it was found the elastomer could be reinforced with a thin metal ring element 35 placed over the seal corner tending to be extruded where the thin metal ring element 25 has overlapping ends and an L-shaped cross-section. The bottom surface 13 of the vessel 11 combined with the top surface 18 of the ring middle section 7 to form a pressure chamber 19 sealed by the seals 15, 18. A port 20 extended through the body of the vessel 11 to communicate with the pressure chamber 19. Liquid under pressure could be introduced into the pressure chamber 19 through port 20 to deform the ring 4 and casing joint side wall 9.

A stop tube 21, having an outside diameter of 0.060 inches less than the inside diameter of the casing joint and a length approximately 1.5 times that of the ring 4, was inserted into the bore 17 of the casing joint 1. The stop tube 21 was positioned opposite the ring 4. The function of the stop tube 12 was to limit the extent of deformation of the ring 4 and casing joint side wall 9 to about 2.5 to 3.5 times the elastic limit of the casing joint steel under external pressure loading.

Figure 3:
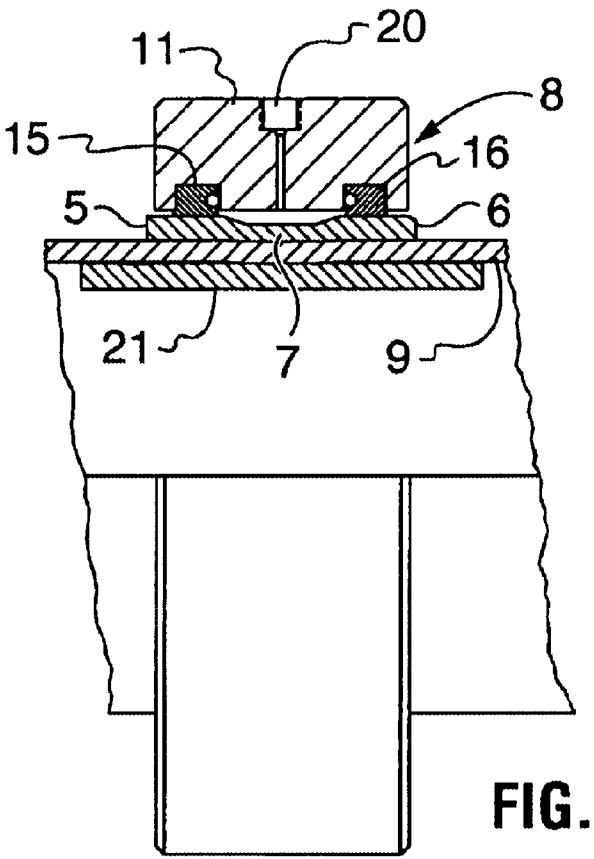
FIG. 3 is a partial cut-away side view of a crimped ring positioned inside the forming vessel under application of the forming pressure.
Figure 2:
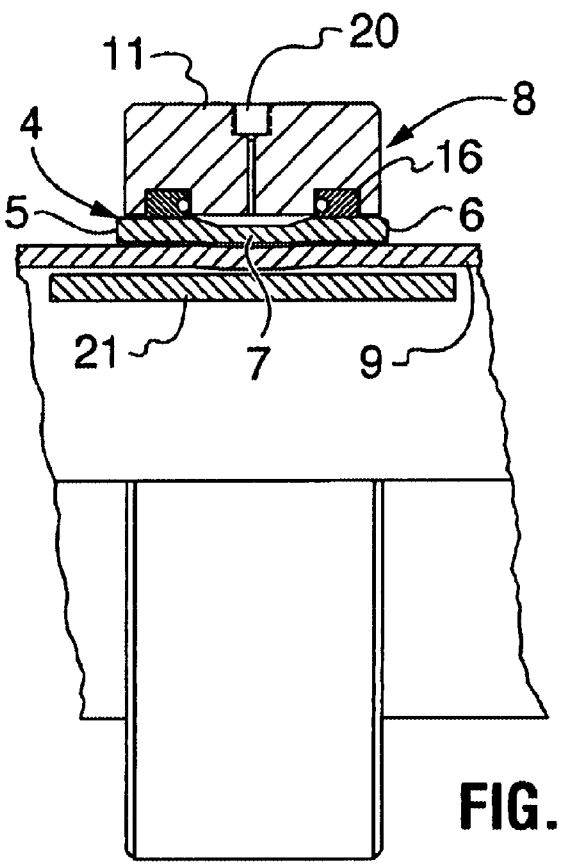
FIG. 2 is a partial cut-away side view of a crimp ring positioned inside a hydroforming vessel and placed on the tubular prior to crimping.

Water under pressure was introduced into the pressure chamber 19. As the pressure was increased, the ring middle section 7 was initially forced into contact with the casing side wall 9. As the pressure was increased to about 15,000 psi, both the ring and casing side wall were forced into contact with the stop tube 21. At this point, the pressure was released. Both the ring 4 and side wall 9 rebounded. As the yield strength of the ring 4 was less than that of the side wall 9, the ring rebounded less, thereby leaving some residual contact stress between the casing side wall 9 and ring 4. The ring 4 was left plastically formed into the slight detent 10 in the side wall 9, and was thus plastically interlocked into the casing wall, as shown in FIG. 3.

This process was repeated to affix 10 rings 4 onto the 40 foot casing joint 1 at a spacing of approximately 3 feet, thereby completing production of the anchor joint 2 shown in FIG. 1.

Figure 5:
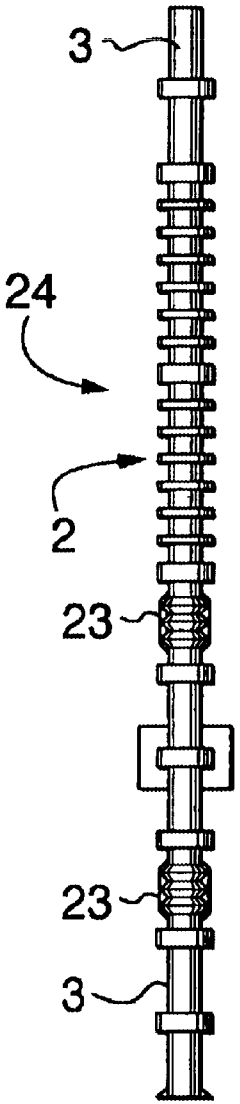
FIG. 5 is a side view showing a plurality of anchor joints incorporated into a casing string.
Figure 4:
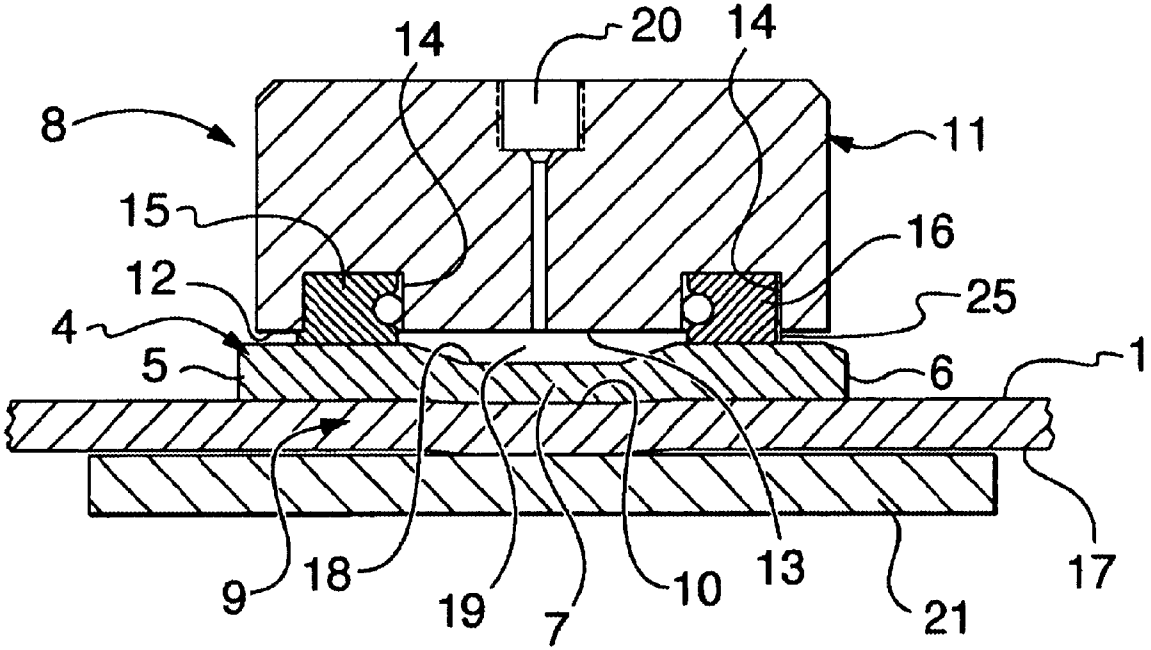
FIG. 4 is a cross-section through the wall of the assembly of FIGS. 2 and 3, showing the configuration of an elastomer metal back up ring for containing the seals.

Two such anchor joints 2 were then inserted in a casing string 3, as shown in FIG. 5, together with corrugated compression joints 23 (available from SynTec Inc. of Edmonton Alberta, Canada, under the trade mark DuraWAV). The assembly 24 was then run into a well and cemented in place.

When an anchor joint thus formed is cemented into a well, the cement cast around the rings provides a compressive reaction point at each ring face, effectively 'locking' them into the cement. If the casing is subsequently subjected to sufficient axial load to cause it to displace relative to the rings and cement, such movement requires the rings to move out of the detent. But this creates additional interference with associated increase in contact stress and frictional resistance tending to arrest the movement and providing the desired anchor function. The limited amount of slip thus allowed by the crimped rings, provides a 'softer' anchor than rigidly attached rings, delivering more uniform distribution of load transfer between multiple rings with less tendency to sequentially fail the cement. Crimped rings are thus the preferred method of providing a multiplicity of diameter changes on a tubular article functioning as a casing anchor joint. The preferred embodiment of using a hydraulic swaging process to install the crimp rings also avoids potential embrittlement or corrosion attack that may otherwise arise if the rings were welded onto the casing.

Removal of fluids and solids from hydrocarbon bearing reservoirs, such as unconsolidated channel sands on primary production, can lead to either global or local compression of the reservoir. In either case, compression tends to be greatest near the producing wellbore allowing "roof caving" and "floor bulging" to reduce the original thickness. Near vertical production casings traversing such a reservoir interval will thus tend to be shortened or compressed. Reservoir vertical compressive strains range from fractions to tens of a percent. Given the limited elastic range of casing steel, typically 0.25%, straight casing is usually loaded near or beyond its elastic limit [yield capacity].

This in itself leads to potentially damaging compressive loads at connections or perforations, but when combined with reduced lateral support, causes the casing to buckle. Lateral support in such unconsolidated sandstone reservoirs is lost through production of solids. The curvature and magnitude of the resultant buckled shape allowed by the available annular space increases stress, reduces collapse capacity, impairs access and may damage production equipment, such as pumps, located inside the casing in the buckled interval.

If short sections or pups of compliant casing are placed in the casing string above and below the compressing reservoir interval, axial load is reduced, and consequently the buckling amplitude and curvature can be reduced or eliminated, where the interval thickness does not exceed a few tens of meters. However, if these wells are subsequently thermally stimulated by steaming, the heated casing outside this interval will tend to expand and potentially displace into the compliant casing pups known by the trade name DuraWAV. Furthermore, most thermal stimulation processes impose some temperature cycles, even if not intentionally, further tending to over strain the DuraWAV tools.

These deleterious consequences can be overcome if casing anchor joints are employed, particularly above the upper DuraWAV tool as shown in FIG. 5. This figure schematically shows a well design using 7 inch (178 mm) casing joined with industry standard buttress threaded couplings (BT&C) or 8-round short thread couplings (ST&C). Reservoir thicknesses range from less than 10 meters up to about 30 meters thickness. Two anchor joints are employed above the upper DuraWAV tool to ensure heated casing is prevented from displacing downward and compromising the ability of the DuraWAV tool to absorb reservoir compressive strain or maintain pressure integrity.

In another aspect of the preferred embodiment, we the rings can be providing a plurality of diameter changes. While the use of hydroforming has been illustrated as the method of crimping the rings onto the casing, it is to be understood that other crimping methods can be used, as desired.

FIGS. 1 to 5 illustrated a method for preparing casing for use in a wellbore and, in particular, for use to enhance cementing results. The installability of wellbore casing can be enhanced by attachment thereto of devices supporting the installation of the casing. Attachment by crimping provides a rugged interference fit between the casing and the device that is capable of withstanding the axial and radial load of casing installation and substantially does not compromise casing integrity.

Figure 6:
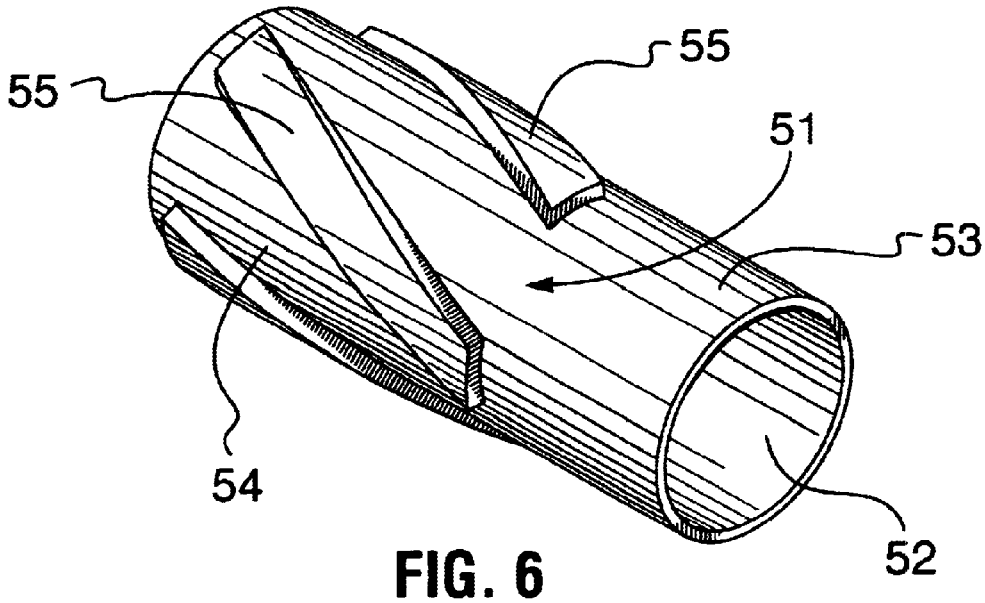
FIG. 6 is a perspective view of another device in the form of a casing centralizer useful in the present invention.

A device useful in the present invention is shown in FIG. 6. The device is a centralizer useful for supporting casing installation by at least maintaining the position of the casing relative to the borehole and accommodating wear against the wall of the borehole into which the casing is run. The centralizer includes metal body 51 containing an internal bore 52, a cylindrical end 53 forming a section suitable for crimping, and a centralizing section 54 on which ribs 55 are placed.

The cylindrical end and the centralizing section are formed integral on the body and the internal bore passes through both of them. While the crimpable section in the illustrated embodiment is cylindrical end 53, it is to be noted that the crimpable section can be formed intermediate a pair of centralizing sections, if desired, rather than on an end. Also, it is to be noted that more than one crimpable section and more than one centralizing section can be provided on the centralizer, as desired.

Ribs 55 are evenly spaced around the centralizing section. There are at least three ribs spaced about the circumference of the centralizing section. Preferably, each rib is helically shaped and the number, length and pitch of the rib helixes are arranged to ensure that the starting circumferential position of each rib overlaps the ending circumferential position of at least one adjacent rib. The ribs may be placed on the centralizer body by a variety of methods including milling, casting, welding or hydroforming. The ribs extend out, with consideration as to the diameter of the borehole in which the casing is to be used, such that they provide for centralization in the borehole. In particular, the effective diameter of the centralizer from the outer surfaces of the ribs should be about equal to the borehole diameter. However, the ribs are spaced to provide openings between the ribs such that fluids can pass by the centralizer as they move up the casing annulus.

Figure 7:
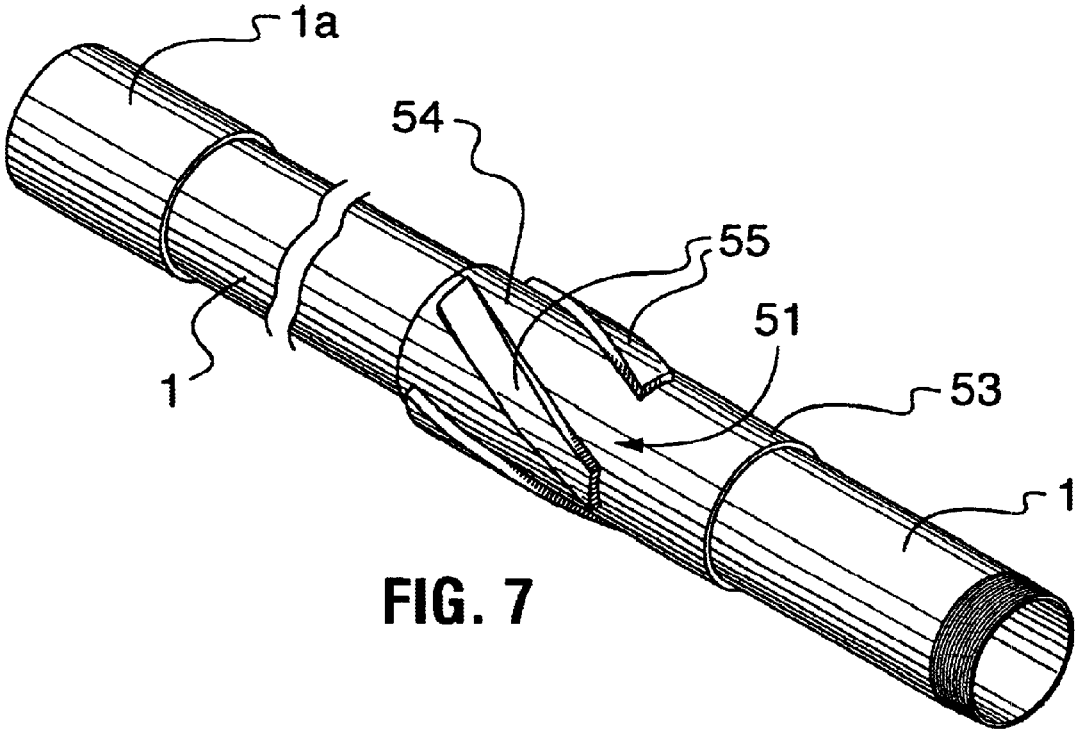
FIG. 7 is a perspective view of the device shown in FIG. 6 placed on a joint of casing as it might appear before crimping.

The internal bore 52 of the centralizer body is selected to loosely fit over at least one end of a thick-wall metal casing 1, shown as a threaded casing joint in FIG. 7 onto which a coupling 1*a* has been threaded. As shown, the internal diameter of bore 52 allows the centralizer to be readily inserted over an end of the casing 1 and placed somewhere along the length of the casing joint prior to crimping. Thus placed, crimping provides a means to obtain a significant interference fit even where the centralizer and casing material are at similar temperatures prior to crimping. In applications where significant heating of the casing and centralizer, after centralizer installation, is anticipated, the centralizer is preferably selected to have a thermal expansion coefficient that is equal to or less than that of the casing. Similarly in applications where cooling subsequent to crimping is anticipated, the opposite relationship between thermal expansion coefficients is preferred.

Figure 8:
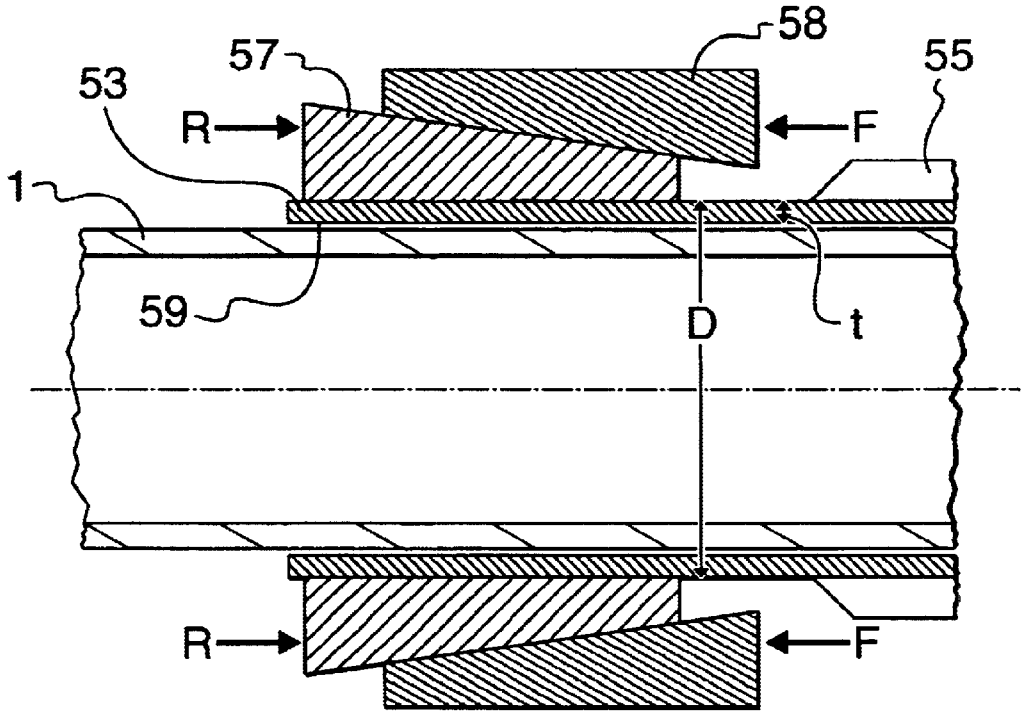
FIG. 8 is a partial sectional schematic view through the wall of a device positioned coaxially on a casing joint and inside a collet crimping tool prior to application of radial crimping displacement.

Radial displacement required to crimp the centralizer cylindrical end 53 to the casing joint 1, on which it is placed, may be accomplished by various methods such as by hydroforming, as described hereinabove. However, a fixture employing a tapered 'collet in housing' architecture has been found to also work well. This welt known method of applying uniform radial displacement, and consequently radial force when in contact with the exterior of a cylindrical work piece, employs a device as shown schematically in FIG. 8. The device retains the externally tapered fingers or jaws 57 of a collet (segments of an externally conical sleeve) inside a matching internally tapered solid housing 58. Application of axial setting force to the housing 58, as shown by vector F, which is reacted at the face 57*a* of the collet jaws 57, as shown by vector R, tends to induce the collet jaws 57 to penetrate into the collet housing 58 along the angle of its conical bore. This causes the jaws 57 to move radially inwardly and engage the work piece to be gripped, in the present case, shown as the cylindrical end 53 of a centralizer. (Alternately, the action of the collet may be described in terms of setting displacement, understood as axial displacement of the collet housing 58 with respect to the collet jaws 57, In this case the setting force is understood to arise correlative with the setting displacement.) The axial force F and reaction R are readily applied by, for example, a hollow bore hydraulic actuator (not shown), arranged with an internal bore greater than the casing 1 outside diameter.

Figure 9:
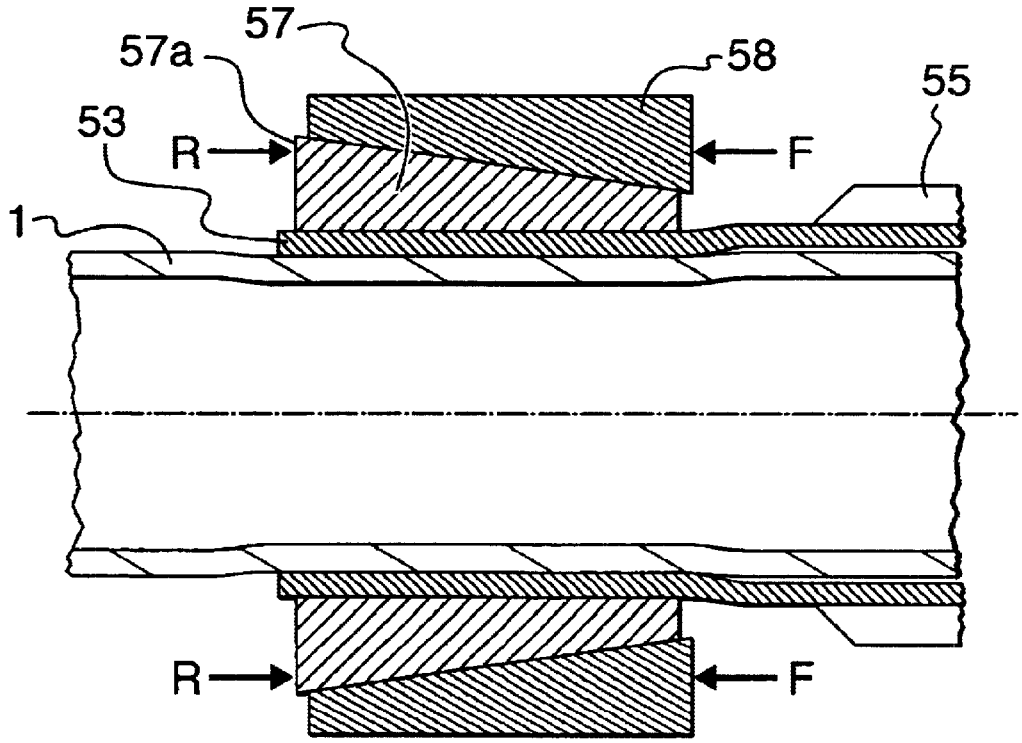
FIG. 9 is the partial sectional schematic view of the assembly shown in FIG. 8 as it would appear after application of radial crimping displacement.

With this arrangement, upon application of sufficient force (F), the jaws may be forced inward to first cause sufficient radial displacement to plastically deform the centralizer cylindrical end 53 and bring it into contact with the casing 1. This amount of radial displacement removes the annular clearance of the loose fit initially required for placing and positioning the centralizer on the casing 1. Application of additional setting force then forces both the centralizer cylindrical end 53, and the underlying wall of the casing 1, inward. In the preferred embodiment the setting displacement is preferably applied until the hoop strain in the casing wall at the crimp location equals or slightly exceeds its elastic limit. It will be apparent to one skilled in the art that radial displacement beyond this point will cause little increase in residual interference but will have the effect of reducing the drift diameter of the casing joint 1. FIG. 9 schematically shows the collet, centralizer and casing as they might appear in the fully crimped position. After the desired radial displacement is achieved, the setting displacement of the collet is reversed which releases it from the centralizer allowing the collet to be removed, leaving the centralizer crimped to the casing.

To ensure that this method of cold crimping (i.e., mechanical crimping unassisted by thermal effects) results in sufficient residual interference between the centralizer cylindrical end 53 and the casing 1, the centralizer material at the cylindrical end 53 has an elastic limit less than that of the casing. As is typically the case, the centralizer and casing material are both made from carbon steel having nearly the same elastic modulii. Therefore, the elastic limit may be expressed in terms of yield strength, since elastic limit is generally given by yield stress divided by elastic modulus.

For example, in one trial conducted to assess the torque capacity to be obtained by crimping a centralizer to 7 inch diameter API grade L80 26 ppf casing material (minimum specified yield strength of 80,000 psi), steel centralizer material having a measured yield strength of 47,000 psi was selected. The centralizer elastic limit was thus less than 50% that of the casing. Using this material, a centralizer having an outside diameter of 7.625 inches, an inside diameter of 7.125 inches and a machined inside bore, was constructed for one trial. After crimping this centralizer to the casing over a 3.5 inch section using the method of the present invention described above, the axial force required to displace the centralizer was measured to be approximately 20,000 lbf. Had this sliding force been applied through torsion, the required torque to induce sliding rotation of the centralizer relative to the casing would be 5833 ftlb. This may be compared to the maximum expected total drilling torque for this size of casing, which is in the order of 20,000 ftlb. Given this crimped centralizer configuration, the torque transferred between just one such centralizer and casing, would need to exceed 25% of the total worst case drilling torque, to induce slippage of the centralizer on the casing.

However, in certain applications it may be desirable to further enhance the load transfer capacity of a centralizer attached to casing, without increasing the crimped length, by improving the frictional engagement achieved for a given level of interference. While this may be accomplished by various means, roughening one or both of the cylindrical end inner wall or the casing outer surface on which the centralizer was to be crimped, was found to be particularly effective. In one trial using a centralizer configured similar to that described in the preceding example, but where the wall surface 59 defining the internal bore 52 of the centralizer was roughened by grit blasting prior to crimping, the equivalent torque capacity was increased approximately 70%.

The length of the section crimped will in general linearly affect the load transfer capacity of the crimped connection. For centralizers attached to full length casing joints, the length of section suitable for crimping, provided by the cylindrical end 53 may be extended almost without limit. Similarly the length of the collet jaws 57, do not limit length that may be crimped. The collet tool may be used to apply the required radial displacement at multiple axial locations to incrementally crimp an extended length cylindrical end 53. Increased load transfer capacity may thus be readily achieved by increasing the crimped section length.

Figure 10:
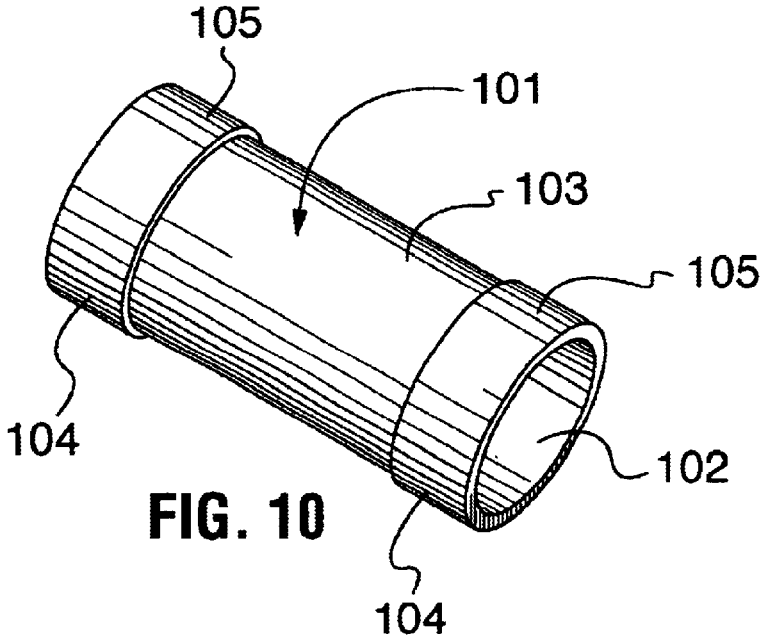
FIG. 10 is a perspective view of another device supporting use of the casing in a wellbore, the device being in the form of a casing wear band tool.

Referring to FIG. 10, another device supporting the installation of wellbore casing is shown that is useful in the present invention. While centralizers as shown in FIG. 6 could be attached to the casing at frequent enough intervals to prevent wear, other less elaborate devices, such as the wear band tool of FIG. 10 can be used to facilitate run in and/or to accommodate wear.

The wear band tool includes a metal body 101 containing an internal bore 102, a cylindrical mid-section 103 forming a section suitable for crimping, and two end intervals 104 on which hard-faced wear bands 105 are placed. As shown, a concentric wear band 105 is placed at each end of the wear band tool forming slightly raised diameter intervals. These wear bands are formed by attaching hard-facing material as commonly known to the industry to metal body 101. The wear band tool is attached to casing by crimping over a portion of cylindrical mid-section 103 using the methods described above for the centralizer tool.

Wear bands, if they extend continuously about the entire circumference, should be selected with consideration as to the diameter of the borehole in which the wear band tool is to be used, such that the wear bands do not extend the full diameter of the borehole. This provides that the wear bands do not block fluids passing up the annulus between the casing and the borehole wall.

Figure 11:
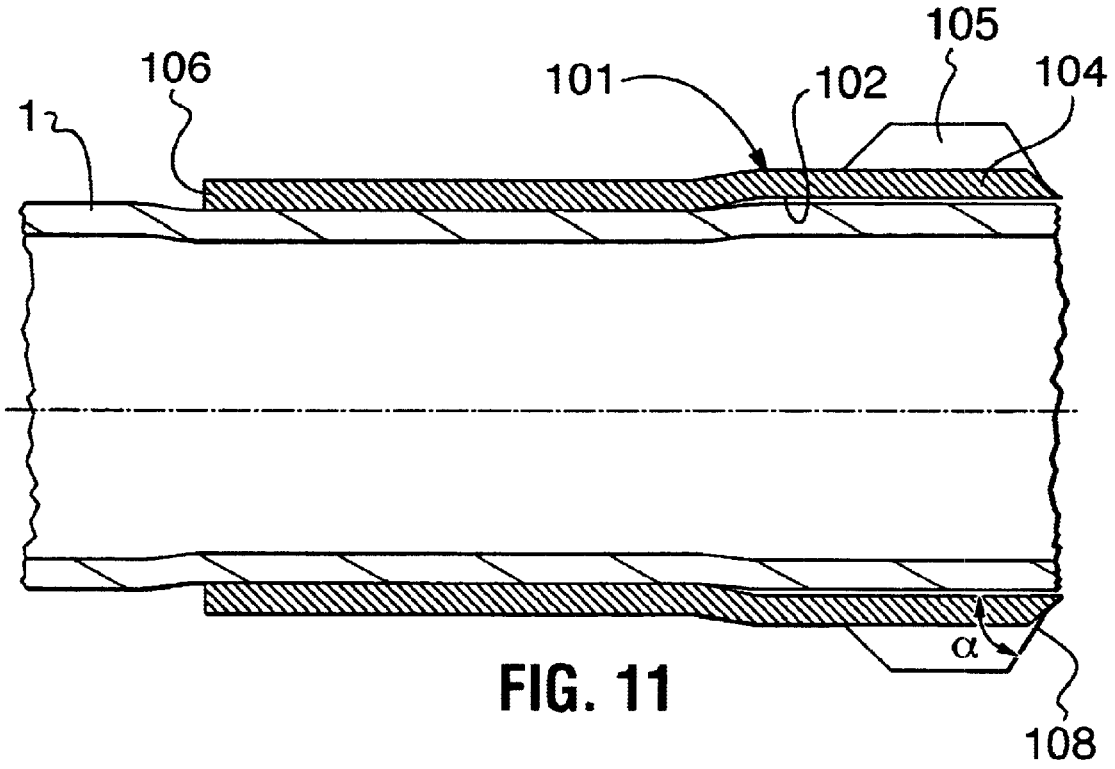
FIG. 11 is an axial sectional view through another device supporting installation of casing shown crimped on a joint of casing.

Another wear band tool is shown in FIG. 11 in crimped form on a joint of casing 1. The wear band facilitates installation of casing and includes a metal body 101 containing an internal bore 102, a cylindrical end section 106 forming a section suitable for crimping, and an interval 104 on which a wear band 105 is securely mounted. An end 108 of the wear band tool is ramped to facilitate passage thereover of discontinuities in the borehole. End 108 has a leading edge ramp angle a between the ramped surface and the surface 9 of the inner bore that is selected to ease movement of the casing through the borehole by reducing drag of the casing and casing connections as the casing is advanced through the borehole, especially in horizontal sections, where the casing lies against the borehole wall. Generally, the angle $\alpha$ is selected to be less than about 60° and preferably less than 45° and most preferably less than about 20°. This ramped leading edge is preferably positioned facing downhole to facilitate run in of the casing joint on which it is mounted.

The wear band tool can also be used downhole of a shoulder on the casing, such as a coupling, wherein the ramped leading edge 108 can facilitate passage of the casing through the borehole by preventing the casing shoulder from digging into the formation. The wear band tool can, therefore, be used alone to space the casing from the borehole wall and to accommodate wear, since the wear band 105 will wear preferentially over the shoulder on the casing.

It will be apparent that these and many other changes may be made to the illustrative embodiments, while falling within the scope of the invention, and it is intended that all such changes be covered by the claims appended hereto.

What is claimed is:

1. A method for preparing casing for use in a wellbore comprising: selecting a joint of casing having an outer diameter and an outer surface and capable of receiving a device thereon by crimping and selecting a device supporting the use of the casing in a wellbore, the device having an outer facing surface, an inner bore sufficiently large to allow insertion therethrough of the joint of casing, and at least one tubular section on the body, the portion of the inner bore extending through the tubular section having an internal diameter capable of loosely fitting about the outer diameter of the joint of casing; positioning the device on the joint of casing such that the joint of casing extends through the inner bore; and crimping the device onto the joint of casing by applying an inward, substantially radially-directed force to a plurality of points about an outer circumference of the tubular section causing it to plastically deform inwardly and come into contact with the outer surface of the joint of casing, applying such additional inward, substantially radially directed force as required to force both the tubular section of the device and the outer surface of the casing to displace inwardly an amount at least great enough so that when the force is released, an interference fit is created between the device and the casing.

2. The method of claim 1 wherein the casing is for wellbore completion.

3. The method of claim 1 wherein the casing is for use in a drill string.

4. The method of claim 1 wherein the casing is prepared to act as an anchor joint.

5. The method of claim 1 wherein the device supporting the use is selected from those useful for facilitating run in of the casing.

6. The method of claim 5 wherein the device supporting the use includes a ramped leading edge and the device is installed such that the ramped leading edge is positioned facing downhole.

7. The method of claim 1 wherein the device supporting the use is selected from those for accommodating wear against the wall of the borehole into which the casing is run.

8. The method of claim 7 wherein the device supporting use has a bearing surface on its outer facing surface, the bearing surface being selected to withstand wear against the borehole wall to a degree greater than the casing.

9. The method of claim 8 wherein the bearing surface includes hard-facing.

10. The method of claim 1 wherein the device supporting the use is selected from those useful for positioning the casing in a borehole in which the casing is to be run.

11. The method of claim 1 wherein the device supporting use is a centralizer.

12. The method of claim 1 wherein the device supporting use is a wear band tool.

13. The method of claim 1 wherein the device is a ring having at least one shoulder, which when interference fit onto the casing, form an abrupt change in casing outer diameter.

14. The method of claim 1 wherein the substantially radially directed force is applied by hydroforming.

15. The method of claim 1 wherein the substantially radially directed force is applied by a collet reacting in a cone applied axially thereabout.

16. A casing joint prepared for use in a wellbore comprising: a joint of casing adapted for connection into a casing string; a device installed onto the outer surface of the joint of casing, the device including a tubular section having an inner bore, the device installed by inserting the joint of casing through the inner bore of the device and applying an inward, substantially radially-directed force to a plurality of points about an outer circumference of the tubular section causing it to plastically deform inwardly and come into contact with the outer surface of the joint of casing, applying such additional inward, substantially radially directed force as required to force both the tubular section of the device and the outer surface of the joint of casing to displace inwardly an amount at least great enough so that when the force is released, an interference fit is created between the device and the joint of casing.

17. The casing joint of claim 16 wherein the device is selected from those useful for facilitating run in of the joint casing by reducing drag against the wellbore.

18. The casing joint of claim 17 wherein the device includes a ramped leading edge and the device is installed such that the ramped leading edge is positioned facing downhole.

19. The casing joint of claim 16 wherein the device is selected from those for accommodating wear against the wall of the borehole into which the casing is run.

20. The casing joint of claim 19 wherein the device has a bearing surface on its outer facing surface, the bearing surface being selected to withstand wear against the borehole wall to a degree greater than the casing.

21. The casing joint of claim 20 wherein the bearing surface includes hard-facing.

22. The casing joint of claim 16 wherein the device is a wear band tool.

23. The casing joint of claim 16 wherein the device is a ring having at least one shoulder, which when interference fit onto the casing, form an abrupt change in casing outer diameter.

24. The casing joint of claim 16 wherein the device is selected from those useful for positioning the casing in a borehole in which the casing is to be run.

25. The casing joint of claim 16 wherein the device is a centralizer.

* * * * *

UNITED STATES PATENT AND TRADEMARK OFFICE

CERTIFICATE OF CORRECTION

PATENT NO. : 6,679,335 B2 
DATED : January 20, 2004
INVENTOR(S) : Maurice William Slack and Trent Michael Victor Kaiser It is certified that error appears in the above-identified patent and that said Letters Patent is hereby corrected as shown below:

Title page,
Add the following:
-- [30] Foreign Application Priority Data
Jun. 15, 2001 (CA) 2,350,681
Jul. 18, 2001 (CA) 2,353,249 --; and
-- [63] Related U.S. Application Data
Continuation-in-part of application No. 09/736,977, filed on December 14, 2000 --

Signed and Sealed this

Tenth Day of August, 2004

JON W. DUDAS
*Acting Director of the United States Patent and Trademark Office*